United States Patent [19]

Davidson

[11] 4,285,914

[45] Aug. 25, 1981

[54] RECOVERY OF LITHIUM FROM LOW-GRADE ORES

[75] Inventor: Charles F. Davidson, Layton, Utah

[73] Assignee: The United States of America as represented by the Secretary of the Interior, Washington, D.C.

[21] Appl. No.: 116,697

[22] Filed: Jan. 30, 1980

[51] Int. Cl.[3] ..... C01D 3/08

[52] U.S. Cl. ..... 423/179.5

[58] Field of Search ..... 75/111, 113, 114; 423/179.5

[56] References Cited

U.S. PATENT DOCUMENTS

| | | | |
|---|---|---|---|
| 385,345 | 7/1888 | Faure | 75/113 |
| 846,657 | 3/1907 | Frolich | 75/113 |
| 1,013,498 | 1/1912 | Koehler | 75/113 |
| 1,247,619 | 11/1917 | Beckett | 423/499 |
| 1,384,465 | 7/1921 | Hey | 75/113 |
| 1,392,043 | 9/1921 | Booth et al. | 75/113 |
| 1,870,478 | 8/1932 | Bacon et al. | 75/113 |
| 2,843,472 | 7/1958 | Eberhardt | 75/113 |
| 2,893,828 | 7/1959 | Peterson | 423/179.5 |
| 3,909,249 | 9/1975 | Coldrey et al. | 75/113 |

*Primary Examiner*—O. R. Vertiz

*Assistant Examiner*—Wayne A. Langel

*Attorney, Agent, or Firm*—William S. Brown; Donald A. Gardiner

[57] ABSTRACT

Lithium is recovered from low-grade ores, such as clays, by addition of CaO or $CaCO_3$ and chlorination with $H_2O$-HCl vapor to convert the lithium to soluble LiCl.

5 Claims, No Drawings

RECOVERY OF LITHIUM FROM LOW-GRADE ORES

The invention relates to recovery of lithium from low-grade ores, such as clays, lepidolite or spodumene, generally containing Li in amounts of about 0.2 to 2.0 percent. Such ores are also characterized by a high content of free silica, e.g., about 10 to 50 percent, generally largely in the form of quartz.

Prior art methods for extraction of lithium from its ores are generally based upon concentration of the ore, with subsequent high temperature roasting. For example, recovery of lithium from spodumene requires roasting above 1000° C., followed by a low temperature roast with $H_2SO_4$. Other proposed roasting methods employ mixtures of CaO or $CaCO_3$, $CaSO_4$, $CaCl_2$, or similar salts. Such processes, however, require mineral beneficiation, high roasting temperatures, and long reaction times. In addition, several extraction methods have used chlorination with gaseous compounds. However, these reactions are generally nonselective, and the high cost of most of the chlorinating agents employed has limited their successful application. It has, however, been found, in accordance with the teachings of copending application Ser. No. 116,695, filed Jan. 30, 1980 that extraction of lithium from its ores, e.g., clays, may be efficiently and economically achieved by selective chlorination of the lithium in the ore to form water soluble lithium chloride. However, it has also been found that recovery of lithium by such a process is limited when using gaseous $H_2O$-HCl mixtures to selectively chlorinate lithium-containing clays that have a high free silica content. This is believed due to formation of insoluble chlorosilicate, thereby tying up alkali metals and limiting their conversion to soluble form. The free silica in the clays may consist of quartz, cristobalite, amorphous silica, etc., that are initially present in the clay, as well as $SiO_2$ that is formed as a reaction product when the clay is reacted with HCl.

It has now been found, according to the process of the invention, that the deficiencies of the prior art processes may be largely overcome, and an efficient recovery of lithium from low-grade ores, particularly clays, achieved by combined addition of CaO or $CaCO_3$ to the clay, and chlorination by means of a gaseous $H_2O$-HCl mixture. The process of the invention is carried out at elevated temperature, e.g., about 450° to 950° C., preferably about 550° to 800° C., at which temperature the CaO, as added or formed by decomposition of $CaCO_3$, reacts with the free silica in the ore to form nonreactive calcium silicate. This process has been found to provide an efficient recovery of lithium from low-grade ores, such as clays, without the necessity of preliminary beneficiation of the ores. In addition, the process enables effective use of a low-cost chlorination reagent, i.e., gaseous $H_2O$-HCl, for lithium recovery.

Optimum amounts of CaO or $CaCO_3$ will depend on the specific ore, composition of the chlorinating reagent, temperature, etc. However, the amount generally should be sufficient to provide about 80 to 200 percent of the stoichiometric amount of CaO for reaction with free silica according to the equation:

$$CaO + SiO_2 \rightarrow CaSiO_3,$$

the stoichiometric ratio of $CaO:SiO_2$ thus being 1:1. As mentioned above, the free silica will include both that originally present in the ore, e.g., quartz, and that formed in the reaction with the chlorinating reagent, e.g., $$Li_2Si_2O_5 + 2HCl \rightarrow 2LiCl + 2SiO_2 + H_2O.$$

Amounts in excess of the stoichiometric amount, i.e., from 100 to 200 percent stoichiometric, have, however, generally been found to provide maximum efficiency of recovery of lithium from most low-grade ores. These amounts will usually correspond to an amount of CaO in the range of about 20 to 35 weight percent of the ore. Addition of the CaO or $CaCO_3$ to the ore may be by any conventional means capable of providing a substantially homogeneous mixture of the materials. For this purpose, the particle size of both the ore and the CaO or $CaCO_3$ is preferably in the range of about 325 mesh to 200 mesh (tyler).

The ore-CaO or ore-$CaCO_3$ mixture is then chlorinated by means of vaporous $H_2O$-HCl, i.e., a mixture of water vapor and hydrogen chloride. Optimum concentration of HCl in the mixture may vary widely, e.g., about 5–90 percent by weight; however, a range of about 20–35 percent is generally preferred from the standpoint of both yield and economy.

The chlorination may be carried out in any conventional apparatus capable of providing the required temperature, pressure and gaseous atmosphere. As discussed above, the temperature should be in the range of about 450° to 950° C., preferably about 550° to 800° C., with corresponding pressures of about 0.75 to 1 atmosphere. The gaseous $H_2O$-HCl is generally most conveniently provided by a flow of the gaseous mixture over or through the ore-CaO or ore-$CaCO_3$ mixture for a time sufficient to effect substantial conversion of lithium compounds in the ore to soluble lithium chloride. Optimum flow rates of the $H_2O$-HCl mixture will also vary with the specific ore, composition of the $H_2O$-HCl mixture and temperature, as well as the amount of the ore and the specific reaction vessel employed, but flow rates of about 5 to 50 cc/min/gram ore are generally satisfactory. Time required for substantial chlorination will also depend on the above-mentioned variables, but will generally be in the range of about 1 to 4 hours.

Following chlorination, the resulting lithium chloride is readily leached from the reaction mixture with water, preferably at a temperature of about 20° to 50° C.

The process of the invention will be more specifically illustrated by the following examples:

EXAMPLE 1

A finely ground clay, containing about 0.6 percent Li and 25 percent $SiO_2$, was mixed with 33 weight percent of finely ground $CaCO_3$ (approximately 200 percent of the stoichiometric amount needed to react with any free silica initially present in the clay or formed during chlorination). This mixture was then chlorinated at 700° C. for 30 minutes by means of $H_2O$-HCl vapor containing 20 percent HCl. Chlorination was done in a one-inch tube furnace fitted with a silica tube, with the $H_2O$-HCl mixture passing over the clay-$CaCO_3$ mixture at a flow rate of 50 cc/min/g ore.

After chlorination, the sample was water leached for 5 minutes at 80° C., resulting in recovery of 70 percent of the lithium in the original clay.

EXAMPLE 2

The procedure in this example was similar to that of Example 1, except that the $H_2O$-HCl mixture contained 33 percent HCl, and chlorination temperature and time were 750° C. and 60 minutes, respectively. This resulted in a 90 percent recovery of the lithium in the original clay.

EXAMPLE 3

The procedure in this example was similar to that of Example 1, except that the amount of $CaCO_3$ employed was 20 weight percent of the clay. This was 90 percent of the stoichiometric amount necessary to react with all free silica. This resulted in a 40 percent recovery of the lithium in the original clay.

It is thus apparent that the use of an amount of $CaCO_3$ substantially in excess of the stoichiometric amount necessary for reaction with all $SiO_2$ gave best results for recovery of lithium from the clay employed in these examples. As discussed above, however, optimum amounts of CaO or $CaCO_3$, as well as other variables, may vary widely for different types of ores.

I claim:

1. A process for recovering lithium from clays comprising (1) admixing the clay with CaO or $CaCO_3$ and (2) reacting the mixture with a chlorinating agent comprising a gaseous $H_2O$-HCl mixture at a temperature of about 450° to 950° C. for a time sufficient to convert a major amount of the lithium in the clay to water-soluble lithium chloride, and subsequently water leaching said lithium chloride from the clay.

2. The process of claim 1 in which the amount of CaO or $CaCO_3$ is at least sufficient to react approximately stoichiometrically with any free silica.

3. The process of claim 1 in which the gaseous $H_2O$-HCl mixture contains about 20–35 percent HCl by weight.

4. The process of claim 1 in which the reaction temperature is about 550°–800° C.

5. The process of claim 2 in which the amount of CaO or $CaCO_3$ is about 100 to 200 percent of the stoichiometric amount necessary for reaction with any free silica.

* * * * *